US011300267B2

(12) United States Patent
Takeuchi

(10) Patent No.: US 11,300,267 B2
(45) Date of Patent: Apr. 12, 2022

(54) VEHICLE LIGHTING UNIT

(71) Applicant: Ichikoh Industries, Ltd., Isehara (JP)

(72) Inventor: Hiroto Takeuchi, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 17/265,034

(22) PCT Filed: Jul. 30, 2019

(86) PCT No.: PCT/JP2019/029827
§ 371 (c)(1),
(2) Date: Feb. 1, 2021

(87) PCT Pub. No.: WO2020/027128
PCT Pub. Date: Feb. 6, 2020

(65) Prior Publication Data

US 2021/0302004 A1 Sep. 30, 2021

(30) Foreign Application Priority Data

Aug. 2, 2018 (JP) ..... JP2018-145559

(51) Int. Cl.

| | |
|---|---|
| ***F21S 45/48*** | (2018.01) |
| ***F21S 45/49*** | (2018.01) |
| ***F21S 41/148*** | (2018.01) |
| ***F21S 41/39*** | (2018.01) |
| ***F21Y 115/10*** | (2016.01) |

(52) U.S. Cl.
CPC ..... *F21S 45/48* (2018.01); *F21S 41/148* (2018.01); *F21S 41/39* (2018.01); *F21S 45/49* (2018.01); *F21Y 2115/10* (2016.08)

(58) Field of Classification Search
None
See application file for complete search history.

(56) References Cited

FOREIGN PATENT DOCUMENTS

| | | | |
|---|---|---|---|
| DE | 10 2007 016 442 | A1 | 10/2008 |
| EP | 3 130 838 | A1 | 2/2017 |
| JP | 2008-288113 | A | 11/2008 |
| JP | 2009-70732 | A | 4/2009 |

(Continued)

OTHER PUBLICATIONS

International Search Report dated Sep. 17, 2019 in PCT/JP2019/029827 filed Jul. 30, 2019, 2 pages.

(Continued)

*Primary Examiner* — Britt D Hanley
(74) *Attorney, Agent, or Firm* — Oblon, McClelland, Maier & Neustadt, L.L.P.

(57) ABSTRACT

A vehicle lighting unit includes: a heat sink (12); a light emitting element disposed in the heat sink (12); and a reflector that is disposed above the light emitting element, and reflects emitted light emitted forward from the light emitting element. The heat sink (12) includes a base portion (22) for disposing the light emitting element on a pedestal portion (21); and a fin portion (23) that is disposed on a back surface of the base portion (22), and radiates heat generated by the light emitting element. The back surface of the base portion (22) is inclined with respect to the pedestal portion (21). In the heat sink (12), a thickness of the base portion (22) is thicker on a lower side of the light emitting element than on a rear side of the base portion (22).

6 Claims, 6 Drawing Sheets

(56) References Cited

FOREIGN PATENT DOCUMENTS

| | | | | | |
|---|---|---|---|---|---|
| JP | 2009070732 | A | * | 4/2009 | |
| JP | 2014-103058 | A | | 6/2014 | |
| JP | 2015-35349 | A | | 2/2015 | |
| JP | 2015035349 | A | * | 2/2015 | ..... F21S 45/48 |
| JP | 2016-182709 | A | | 9/2016 | |
| JP | 2018-006116 | A | | 1/2018 | |
| WO | WO 2013/056939 | A1 | | 4/2013 | |

OTHER PUBLICATIONS

Supplementary European Search Report issued in European Application No. 19844537.1 dated Nov. 19, 2021, citing references AO—AT therein (36 pages).

* cited by examiner

VEHICLE LIGHTING UNIT

TECHNICAL FIELD

The present invention relates to a vehicle lighting unit.

BACKGROUND ART

Conventionally, a vehicle lighting unit that uses a light emitting element as a light source has been used as a headlight or an auxiliary headlight (see, for example, PTL 1). Such a vehicle lighting unit includes a light emitting element and a reflector, and the light emitting element is mounted on a heat sink. The vehicle lighting unit suppresses change in characteristics due to the heat of the light emitting element by radiating the heat generated by the lighting of the light emitting element to the heat sink. The larger the size of the heat sink is, the higher the heat radiation effect is, and therefore the heat sink is molded relatively large and has a thick overall shape.

CITATION LIST

Patent Literature

PTL 1: Japanese Unexamined Patent Application Publication No. 2008-288113

SUMMARY OF THE INVENTION

Problems to be Solved by the Invention

However, in the conventional technology as described in PTL 1, the size of the heat sink causes increase in weight, and the shape of the heat sink causes convection from below to be stagnated. Therefore, the conventional technology as described in PTL 1 cannot realize the weight reduction and improve the heat radiation performance.

The present disclosure has been made in view of such a situation, and is intended to be able to realize weight reduction and improve heat radiation performance.

Means for Solving the Problem

A vehicle lighting unit of one aspect of the present disclosure includes: a heat sink; a light emitting element disposed in the heat sink; and a reflector that is disposed above the light emitting element, and reflects emitted light emitted forward from the light emitting element, wherein the heat sink includes: a base portion for disposing the light emitting element on a pedestal portion on an upper surface of the heat sink; and a fin portion that is disposed on a back surface of the base portion and radiates heat generated by the light emitting element, and the back surface of the base portion is inclined with respect to the pedestal portion.

Effect of the Invention

According to one aspect of the present disclosure, it is possible to realize weight reduction and improve heat radiation performance.

MODE FOR CARRYING OUT THE INVENTION

Hereinafter, an embodiment of a vehicle lighting unit to which the present disclosure is applied will be described in detail with reference to the drawings. The present disclosure is not limited by this embodiment.

(Schematic Configuration)

Figure 1:
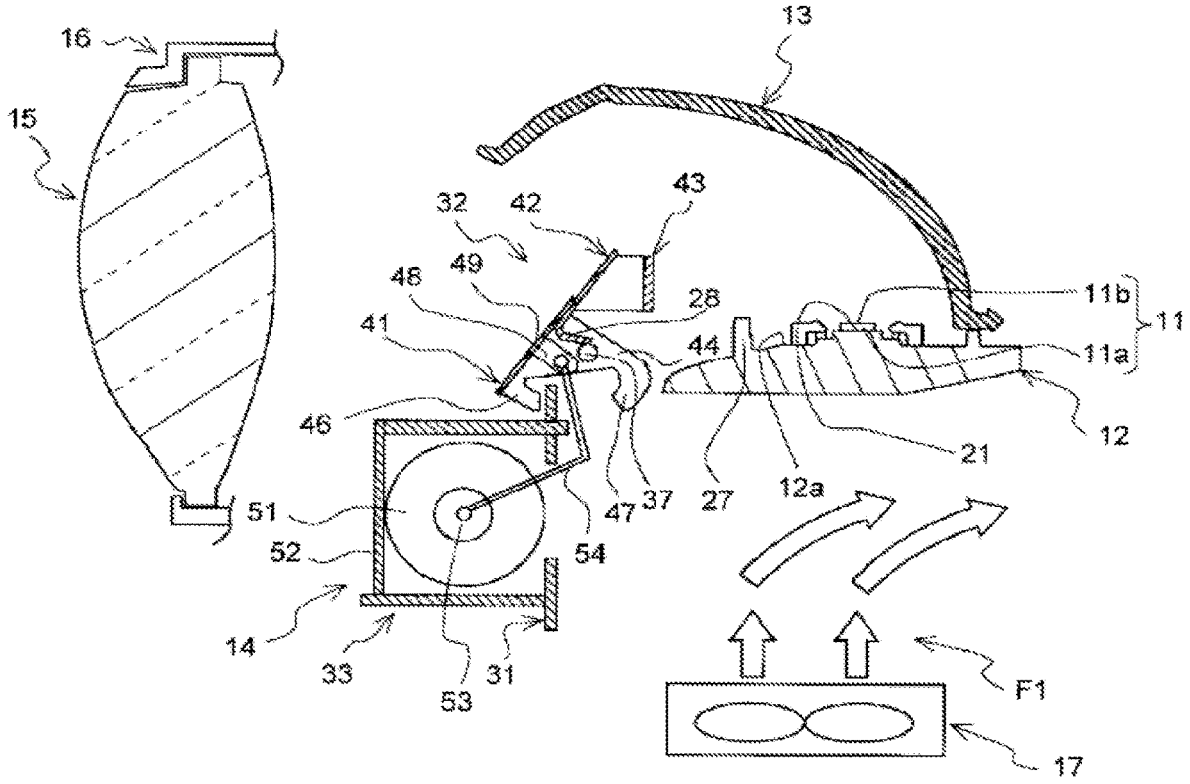
FIG. 1 is a diagram illustrating a structural example of a vehicle lighting unit according to an embodiment to which the present disclosure is applied.
Figure 2:
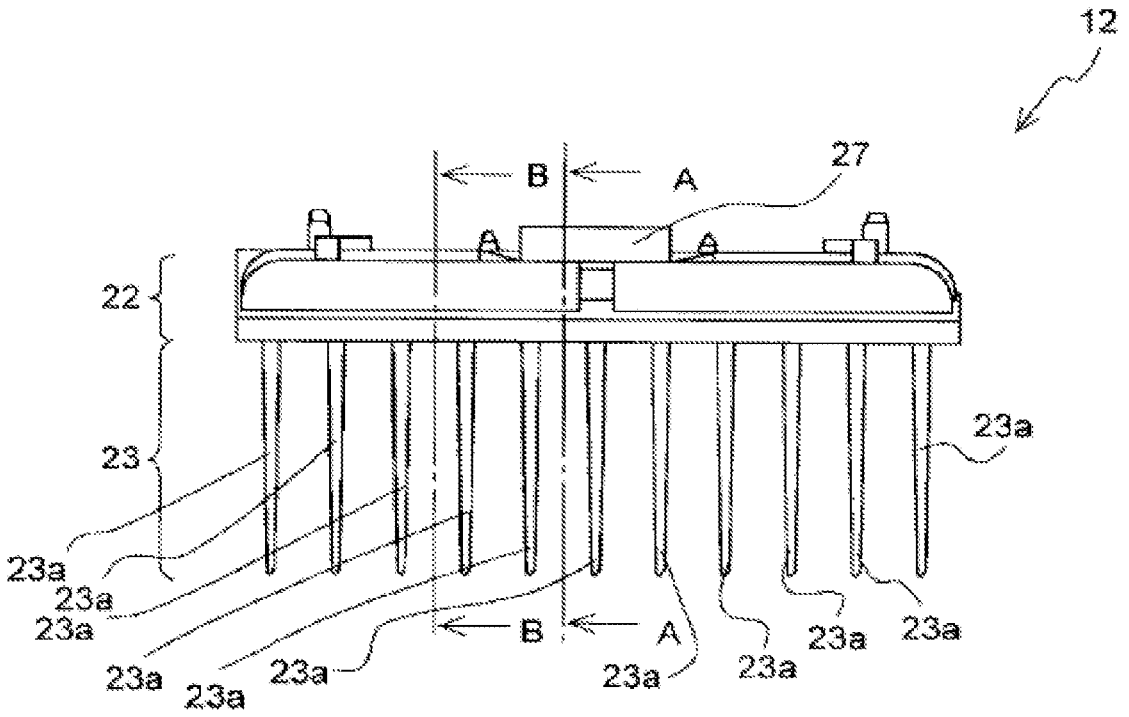
FIG. 2 is a front view of a heat sink 12 according to the embodiment to which the present disclosure is applied.
Figure 3:
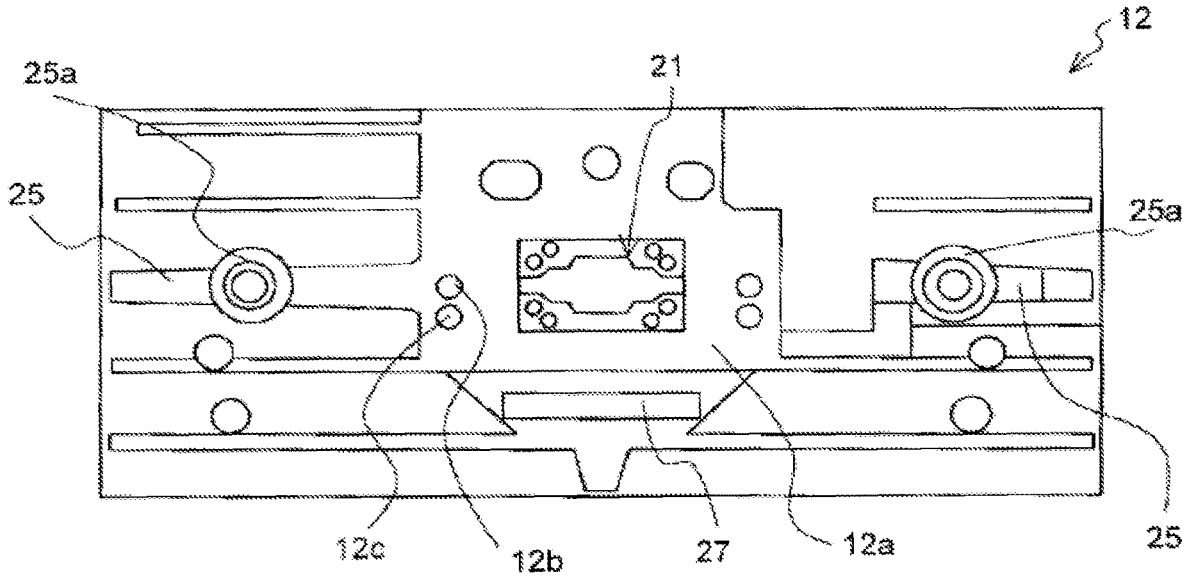
FIG. 3 is a top view of the heat sink 12 according to the embodiment to which the present disclosure is applied.
Figure 4:
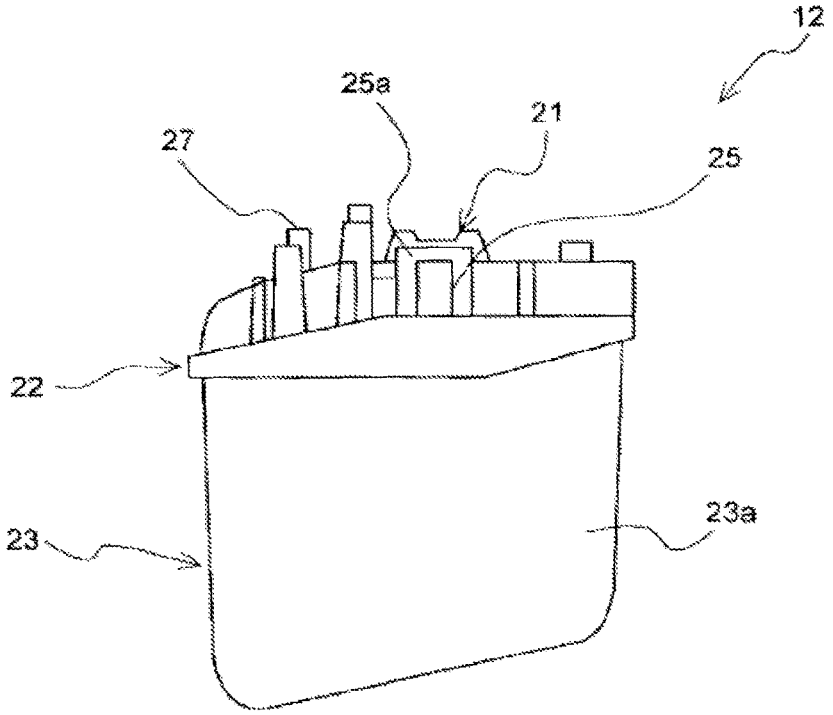
FIG. 4 is a right side view of the heat sink 12 according to the embodiment to which the present disclosure is applied.
Figure 5:
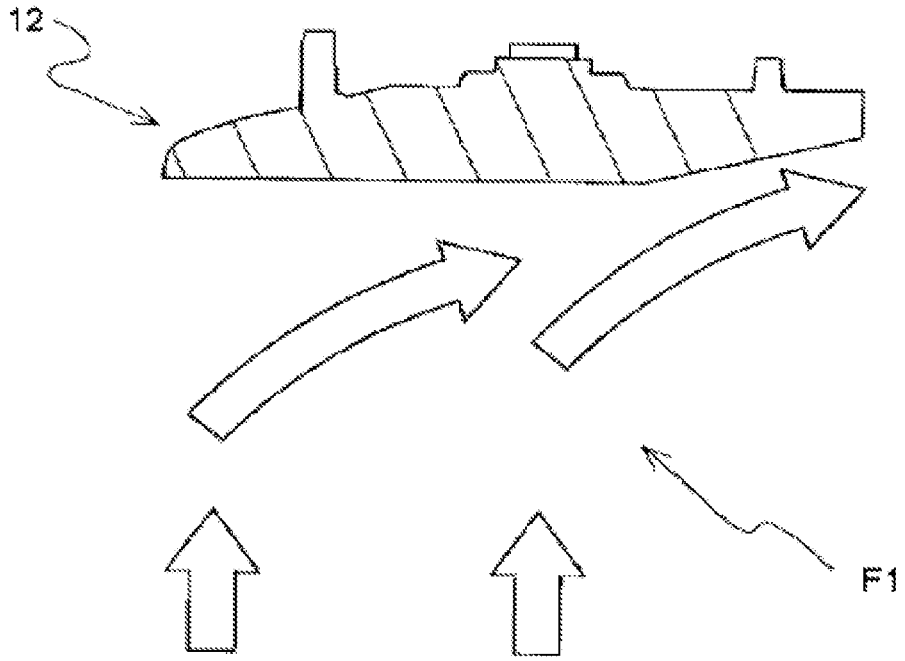
FIG. 5 is a sectional view taken along a line A-A in FIG. 2 of the heat sink 12 according to the embodiment to which the present disclosure is applied.
Figure 6:
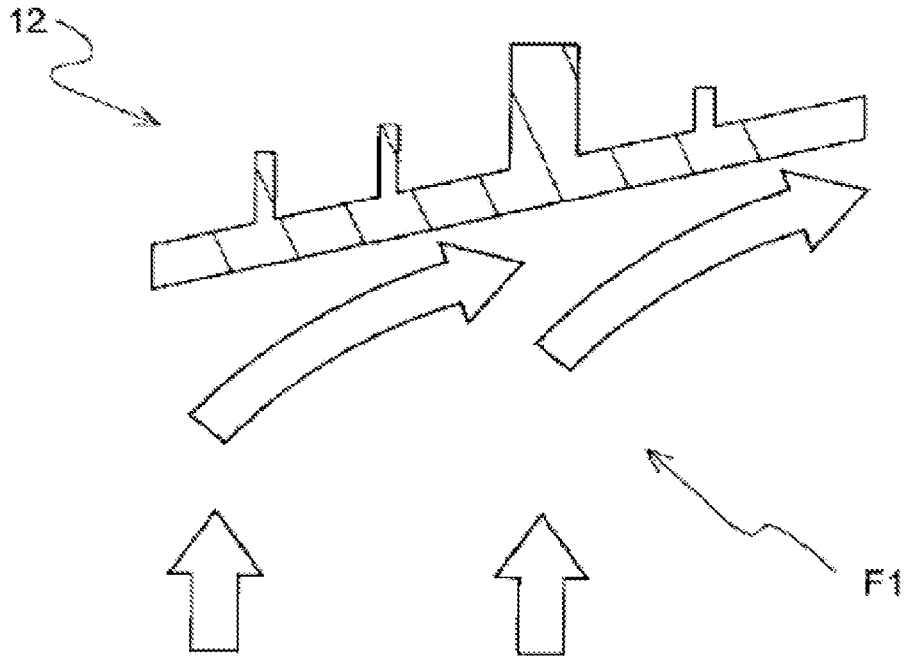
FIG. 6 is a sectional view taken along a line B-B in FIG. 2 of the heat sink 12 according to the embodiment to which the present disclosure is applied.

FIG. 1 is a diagram illustrating a structural example of a vehicle lighting unit according to an embodiment to which the present disclosure is applied. FIG. 2 is a front view of a heat sink 12 according to the embodiment to which the present disclosure is applied. FIG. 3 is a top view of the heat sink 12 according to the embodiment to which the present disclosure is applied. FIG. 4 is a right side view of the heat sink 12 according to the embodiment to which the present disclosure is applied. FIG. 5 is a sectional view taken along a line A-A in FIG. 2 of the heat sink 12 according to the embodiment to which the present disclosure is applied. FIG. 6 is a sectional view taken along a line B-B in FIG. 2 of the heat sink 12 according to the embodiment to which the present disclosure is applied. FIG. 1 illustrates a simple cross-section of each configuration and a partially omitted lens holder 16 in order to make it easier to understand the configuration of the vehicle lighting unit.

Vehicle lighting units are used to form headlights for vehicles such as automobiles. Respective headlights are mounted on the left and right sides of a front portion of the vehicle, and the vehicle lighting unit is provided in a lamp chamber formed by a lamp housing having an open front end covered with an outer lens. The vehicle lighting unit is provided in the lamp chamber via a vertical optical axis adjustment mechanism and a horizontal optical axis adjustment mechanism, and appropriately illuminates the front of the vehicle. The vehicle lighting unit includes a light source 11, a heat sink 12, a reflector 13, a shade unit 14, a projection lens 15, a lens holder 16, and a cooling fan unit 17, and constitutes a projector type headlight unit. A light distribution pattern of the vehicle lighting unit can be switched by using the shade unit 14.

The light source 11 is configured by mounting a light emitting element lib, which is a light emitting diode, on a substrate 11*a*. The substrate 11*a* is disposed on a pedestal portion 21 of an upper surface 12*a* of the heat sink 12, and a power supply holder is attached from above the substrate, and a terminal of the substrate 11*a* is connected to a terminal provided on the power supply holder and fixed to the upper surface 12*a*. Accordingly, the heat sink 12 functions as a stand on which the light source 11 is provided. That is, the light emitting element 11*b* is disposed in the heat sink 12. Therefore, the light source 11 is appropriately lit by supplying electric power from a lighting control circuit to the light emitting element 11*b* via the power supply holder.

The heat sink 12 is a heat radiating member that releases heat generated by the light source 11 provided on the upper surface 12*a* to the outside, includes a base portion 22 and a fin portion 23, and is molded by, for example, die casting. Although the details of the base portion 22 will be described later, the light emitting element 11*b* is disposed on the pedestal portion 21 of the upper surface 12*a* of the heat sink 12. The power feeding holder (not illustrated) is attached to the light emitting element 11*b* disposed on the pedestal portion 21 by screws using a screw hole 12*b* and a screw hole 12*c*. Although the details of the fin portion 23 will be described later, the fin portion 23 is disposed on a back surface of the base portion 22 and radiates heat generated by the light emitting element 11*b*. The heat sink 12 is held by the lamp housing via a bracket (not illustrated) so as to be adjustable up, down, left and right. The heat sink 12 includes a first shading piece 27. The first shading piece 27 is formed by extending a front end of the upper surface 12*a* in the width direction while partially protruding. The first shading piece 27 is located at the front end of the heat sink 12 to block direct light from the light emitting element 11*b*.

The reflector 13 is disposed above the light emitting element 11*b*, and reflects the emitted light emitted from the light emitting element 11*b* to the front projection lens 15. The reflector 13 is positioned and fixed to the heat sink 12 by being screwed into screw holes 25*a* provided in the heat transfer ribs 25. The front is the same direction as the front of the vehicle. The same applies in the following description.

The projection lens 15 projects emitted light reflected by the reflector 13 to the front of the vehicle, and forms a light distribution pattern in cooperation with the reflector 13. The projection lens 15 is supported by the lens holder 16 and is positioned with respect to the light source 11 and the reflector 13. The shade unit 14 switches the light distribution of the projected light projected by the projection lens 15 between a low-beam light distribution pattern and a high-beam light distribution pattern. The shade unit 14 includes a bracket plate 31, a shade 32 whose position is displaced due to the switching of light distribution, a solenoid 33 as a driving unit that displaces the position of the shade 32, and a torsional coil spring 54 that transfers the operation of the solenoid 33 to the shade 32. The bracket plate 31 rotatably supports a rotating shaft 37. The shade 32 blocks a part of the emitted light emitted from the light source 11 to form a cut-off line of the light distribution pattern. The shade 32 is configured by attaching a thin plate-shaped first shade portion 42 and a second shade portion 43 to a rotation base 41. The rotation base 41 is provided with a bearing piece 44, and the rotating shaft 37 is inserted into the shaft hole. The rotation base 41 includes a first positioning piece 46, a second positioning piece 47, and a transfer piece 48. The transfer piece 48 is formed by bending a U-shaped cutout at the center in the width direction of the rotation base 41. The opening 49 is formed at a position where the transfer piece 48 is present before the U-shaped cutout at the center in the width direction of the rotation base 41 is bent.

The first shade portion 42 is attached to the upper portion of the rotation base 41. The second shade portion 43 is attached to the first shade portion 42 at a regular interval from the first shade portion 42. The shade 32 includes a second shading piece 28 formed so as to protrude toward the light source 11 above the opening 49. The second shading piece 28 is formed by bending a lower end of the first shade portion 42. The second shading piece 28 is located on a path from an upper portion of the reflector 13 to the projection lens 15 through the rotation shaft 37 and the opening 49. The solenoid 33 includes a coil 51, a yoke 52 having the coil 51 built therein, and a plunger 53 that advances and retreats from the yoke 52, and the yoke 52 is fixed to a front surface of the bracket plate 31. One end of the torsional coil spring 54 is attached to a tip of the plunger 53. The other end of the torsional coil spring 54 is attached to the transfer piece 48. Therefore, the plunger 53 that advances and retreats due to energization and de-energization of the coil 51 displaces the position of the shade 32.

The cooling fan unit 17 is provided below the heat sink 12, and is configured by rotatably providing a cooling fan inside a rectangular parallelepiped shaped frame. In the cooling fan unit 17, when the light source 11 emits light, the cooling fan is rotated by driving of the motor, and convection F1 is generated, so that the lower side of the heat sink 12 is cooled, and failure caused by the heat generated by the light source 11 is prevented.

(Essential Constitution)

Now, the heat sink 12 will be described in detail. In the heat sink 12, a back surface of the base portion 22 is inclined upward from the front to the rear with respect to the pedestal portion 21. That is, the back surface of the base portion 22 has a flat configuration and is provided with an inclination that is oriented upward toward the rear. Therefore, in the heat sink 12, the thickness of the base portion 22 is thicker on the lower side of the light emitting element 11*b* than on the rear side of the base portion 22. In addition, as described above, in a case where the headlight unit of the projector type is configured, the shade 32, the projection lens 15 and the like are attached in front of the heat sink 12. If the back surface of the base portion 22 is inclined upward from the rear to the front, the convection F1 generated by the cooling fan unit 17 flows into a space that is inside the reflector 13 and where the shade 32 is attached, and therefore the reflector 13 and the shade 32 hinders the convection F1. However, the back surface of the base portion 22 is configured so as to be inclined upward from the front to the rear, so that the convection F1 goes from the lower side of the heat sink 12 toward the reflector 13 along the back surface of the heat sink 12, and further goes along the outside of the reflector 13, and therefore the convection is generated in one direction.

The heat sink 12 includes the heat transfer ribs 25. The heat transfer ribs 25 are disposed on the same surface side as a surface on which the light emitting element lib is disposed, along the direction from the center of the light emitting element 11*b* to the outside. That is, the heat transfer ribs 25 are disposed radially from the center of the light emitting element 11*b* and in a straight line passing through the center of the light emitting element lib. With such a disposition configuration, the heat transfer ribs 25 efficiently transfer the heat generated by the light emitting element 11*b* to the outside of the light emitting element 11*b*. The heat transfer ribs 25 are integrally molded by die casting together with the base portion 22 and the fin portion 23.

The fin portion 23 includes heat radiating fins 23*a*. The heat radiating fins 23*a* are plate-shaped plate fins disposed at regular intervals along the horizontal direction. In the heat sink 12, the back surface of the base portion 22 extends in the front-rear direction on the lower side of the light emitting element lib, and the tip end side of the heat radiating fins 23*a* is inclined along the back surface of the base portion 22. With such a configuration, the back surface side of the base portion 22 and the tip side of the heat radiating fins 23*a* are substantially parallel to each other. Therefore, while the height limitation of the heat radiating fins 23*a* by the mold is considered, the heights of the heat radiating fins 23*a* can be adjusted to the maximum height within a moldable range. It is preferable that the inclination angle α from the horizontal direction upward on the tip side of the heat radiating fins 23*a* is inclined by 5° or more. The inclination angle α may be 5° to 20°, and 10° to 15° is an optimum range.

(Action and Effects)

Figure 7:
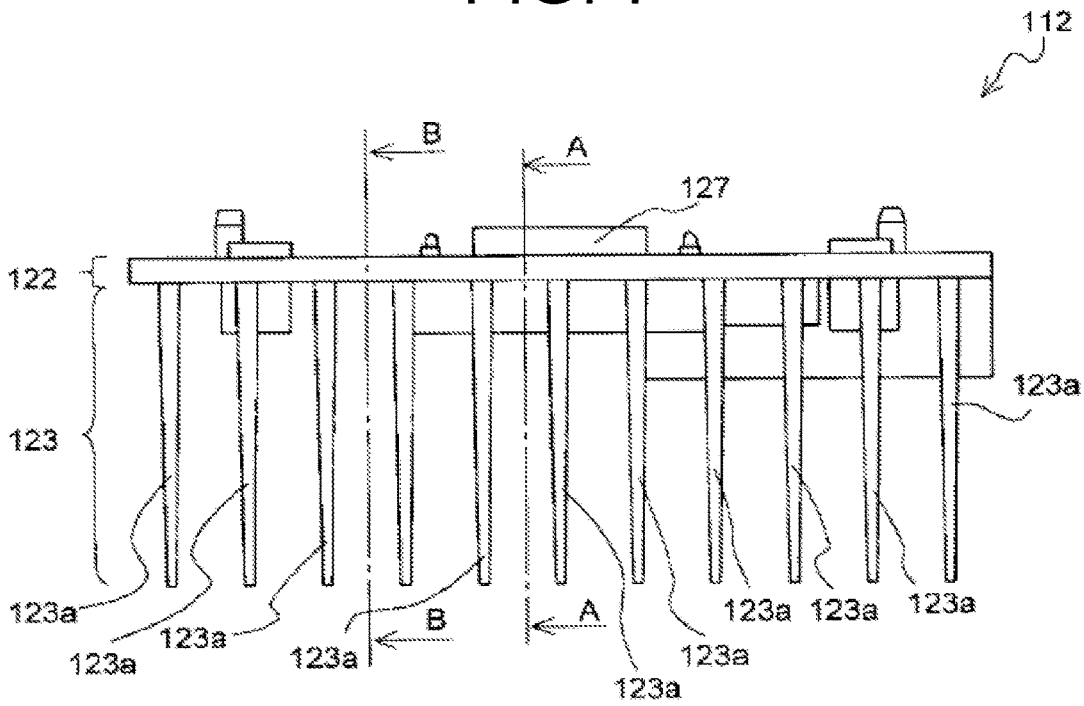
FIG. 7 is a front view of a conventional heat sink 112.
Figure 8:
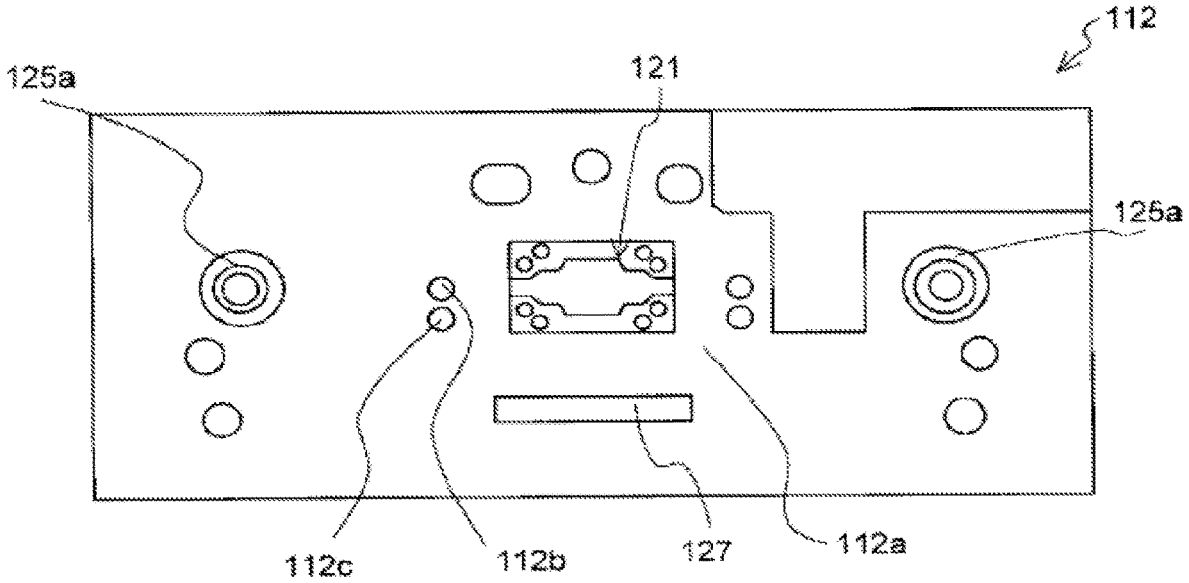
FIG. 8 is a top view of the conventional heat sink 112.
Figure 9:
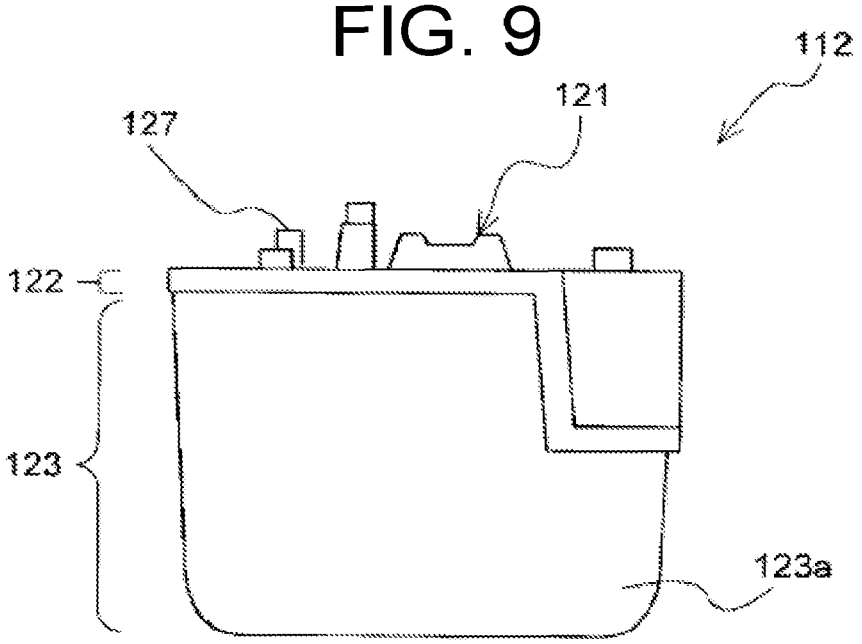
FIG. 9 is a right side view of the conventional heat sink 112.
Figure 10:
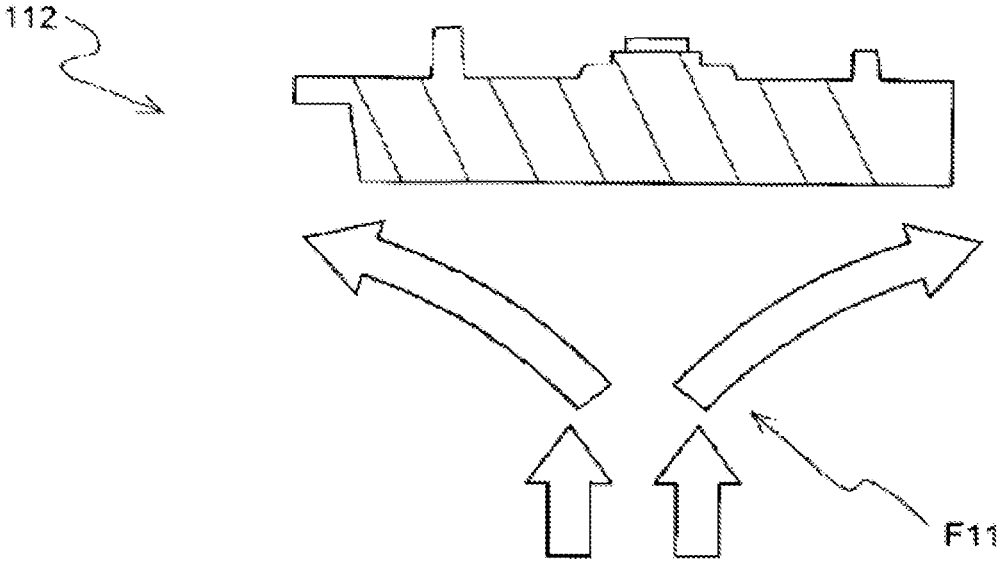
FIG. 10 is a sectional view taken along a line A-A in FIG. 7 of the conventional heat sink 112.
Figure 11:
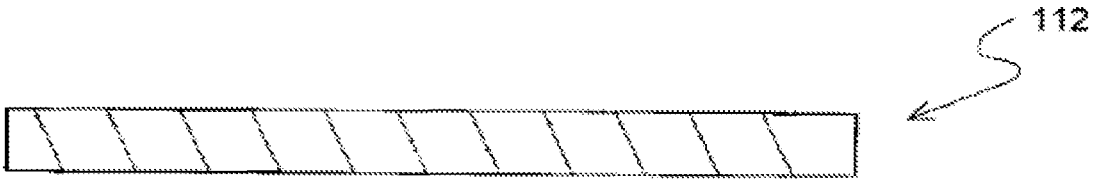
FIG. 11 is a cross-sectional view taken along a line B-B in FIG. 7 of the conventional heat sink 112.

Now, the action and effect of the vehicle lighting unit of this embodiment will be described in comparison with a conventional example. FIG. 7 is a front view of a conventional heat sink 112. FIG. 8 is a top view of the conventional heat sink 112. FIG. 9 is a right side view of the conventional heat sink 112. FIG. 10 is a sectional view taken along a line A-A in FIG. 7 of the conventional heat sink 112. FIG. 11 is a cross-sectional view taken along a line B-B in FIG. 7 of the conventional heat sink 112. The conventional heat sink 112 includes a base portion 122 and a fin portion 123 including heat radiating fins 123*a*, and the base portion 122 is also provided with a first light shading piece 127 on an upper surface 112*a*. In addition to the first light shading piece 127, a pedestal portion 121, a screw hole 112*b*, a screw hole 112*c*, and a screw hole 125*a* are provided on the upper surface 112*a*. In such a configuration, an upper surface 112*a* of the base portion 122 and the back surface side of the base portion 122 are horizontally configured. Therefore, when the pedestal portion 121 is provided, the size becomes larger as a whole, and therefore the thickness of the base portion 122 becomes thicker as a whole. Therefore, since the weight of the heat sink 112 becomes large, it is not possible to reduce the weight. Further, even when convection F11 is generated from below the base portion 122, the convection F11 is generated separately in the front direction and the rear direction of the base portion 122, and therefore a part of the convection F11 flows into a space that is inside a reflector 13 and where the shade 32 is attached. As a result, the convection F11 tends to be stagnant, and the heat radiation performance deteriorates.

Therefore, in this embodiment, the back surface of the base portion 22 is inclined with respect to the pedestal portion 21. Therefore, since the thickness of the base portion 22 is reduced by the amount of the inclination, it is possible to realize the weight reduction. In addition, the direction of the convection F1 is the direction in which the convection flows upward from the front to the rear due to an updraft of the heat generated by the light emitting element 11*b* and the inclination of the back surface of the base portion 22. Therefore, the convection F1 is not drawn into the space inside the reflector 13 from the front of the base portion 22 via the upper side of the light emitting element 11*b*, and therefore the convection F1 is not hindered by the reflector 13 or the like. From the above description, the vehicle lighting unit can realize weight reduction and improve heat radiation performance.

Further, in this embodiment, in the heat sink 12, the thickness of the base portion 22 is thicker on the lower side of the light emitting element 11*b* than on the rear side of the base portion 22. Accordingly, the heat capacity on the lower side of the light emitting element 11*b* that is the heat source is large, and therefore the temperature rise rate around the light emitting element 11*b* can be delayed. Therefore, it is possible to suppress change in the characteristics due to the heat of the light emitting element 11*b*.

Further, in this embodiment, the heat transfer ribs 25 are disposed on the same surface side as the surface on which the light emitting element 11*b* is disposed, along the direction from the center of the light emitting element 11*b* to the outside, and the heat generated by the light emitting element 11*b* is transferred. Accordingly, radiant heat generated by the light emitting element lib can be efficiently transferred as conductive heat to the outside of the light emitting element 11*b*. Therefore, since the temperature around the light emitting element 11*b* can be efficiently transferred to the heat sink 12, it is possible to suppress the temperature rise of the light emitting element 11*b*, and it is possible to prevent the characteristic change such as the decrease in the luminous efficiency due to the heat of the light emitting element 11*b*.

In this embodiment, the tip end side of the heat radiating fins 23*a* is inclined along the back surface of the base portion 22. Accordingly, the height of each heat radiating fin 23*a* can be maximized while the height limitation of the heat radiating fin 23*a* by the mold is considered. Therefore, the heat radiation areas of the heat radiating fins 23*a* can be increased to the maximum within the moldable range, and therefore it is possible to promote a heat radiation effect.

The vehicle lighting units to which the present disclosure is applied is described above based on the embodiment. However, the present disclosure is not limited to this, and change may be made without departing from the gist of the present disclosure.

For example, an example in which the heat radiating fins 23*a* are each composed of a plate-shaped plate fin is described, but the present disclosure is not particularly limited to this. For example, the heat radiating fin 23*a* may be composed of a collage fin.

For example, an example in which the cooling fan unit 17 is provided and the convection F1 is generated by forced convection using the air volume supplied from the cooling fan unit 17 is described, but the present disclosure is not particularly limited to this. For example, even when the cooling fan unit 17 is not provided, convection F1 may be generated by natural convection.

For example, an example in which the back surface of the base portion 22 has a flat configuration and an inclination is provided is described, but the present disclosure is not particularly limited to this. For example, the back surface of the base portion 22 may be curved and be provided with an inclination. That is, the back surface of the base portion 22 only needs to be inclined upward from the front to the rear as a whole, and a part thereof may have a different shape.

DESCRIPTION OF REFERENCE NUMERALS

11 light source, 11*a* substrate, 11*b* light emitting element
12, 112 heat sink, 12*a*, 112*a* upper surface
12*b*, 12*c*, 112*b*, 112*c* screw hole
13 reflector
14 shade unit, 15 projection lens, 16 lens holder
17 cooling fan unit
21, 121 pedestal portion, 22, 122 base portion, 23, 123 fin portion
23*a*, 123*a* heat radiating fin
25 heat transfer rib, 25*a*, 125*a* screw hole
27, 127 first shading piece, 28 second shading piece
31 bracket plate, 32 shade, 33 solenoid
37 rotating shaft, 41 rotation base, 42 first shade portion, 43 second shade portion
44 bearing piece, 46 first positioning piece, 47 second positioning piece, 48 transfer piece
49 opening, 51 coil, 52 yoke, 53 plunger

54 torsional coil spring
F1, F11 convection, an inclination angle
The invention claimed is:

1. A vehicle lighting unit comprising:
a heat sink;
a light emitting element disposed in the heat sink; and
a reflector that is disposed above the light emitting element, and reflects emitted light emitted forward from the light emitting element, wherein
the heat sink includes:
a base portion for disposing the light emitting element on a pedestal portion on an upper surface of the heat sink;
a fin portion that is disposed on a back surface of the base portion, and radiates heat generated by the light emitting element; and
a heat transfer rib that is disposed on a same surface side as a surface on which the light emitting element is disposed, in a straight line passing through a center of the light emitting element along a direction from the center of the light emitting element to outside, and that transfers heat generated by the light emitting element, and
the back surface of the base portion is inclined with respect to the pedestal portion.

2. The vehicle lighting unit according to claim 1, wherein
in the heat sink, a thickness of the base portion is thicker on a lower side of the light emitting element than on a rear side of the base portion.

3. The vehicle lighting unit according to claim 1, wherein
the fin portion includes heat radiating fins composed of plate-shaped plate fins disposed at a regular interval along a horizontal direction, and
in the heat sink, the back surface of the base portion extends in a front-rear direction on the lower side of the light emitting element, and
a tip end side of the heat radiating fins is inclined along the back surface of the base portion.

4. The vehicle lighting unit according to claim 1, wherein
the heat transfer rib is integrally molded by die casting together with the base portion and the fin portion.

5. A vehicle lighting unit comprising:
a heat sink;
a light emitting element disposed in the heat sink; and
a reflector that is disposed above the light emitting element, and reflects emitted light emitted forward from the light emitting element, wherein
the heat sink includes:
a base portion for disposing the light emitting element on a pedestal portion on an upper surface of the heat sink; and
a fin portion that is disposed on a back surface of the base portion, and radiates heat generated by the light emitting element, and
the base portion extends on front and rear sides from the light emitting element, and the back surface in the rear direction of the base portion is inclined with respect to the pedestal portion.

6. The vehicle lighting unit according to claim 5, wherein
a thickness of the base portion is thicker on a lower side of the light emitting element than on each of the front side and the rear side of the base portion.

* * * * *